United States Patent [19]

Chou

[11] Patent Number: 4,714,137

[45] Date of Patent: Dec. 22, 1987

[54] BUILDING SAFETY RESCUE DEVICE

[76] Inventor: Hung-Chang Chou, No. 5, Shin Ho 2nd Road, Tainan, Taiwan

[21] Appl. No.: 857,094

[22] Filed: Apr. 29, 1986

[51] Int. Cl.[4] ..... A62B 1/14

[52] U.S. Cl. ..... 182/193; 182/235; 182/240; 188/65.1

[58] Field of Search ..... 182/235, 240, 5–7, 182/236, 193; 188/65.1

[56] References Cited

U.S. PATENT DOCUMENTS

| | | | |
|---|---|---|---|
| 279,744 | 6/1883 | Greene | 182/5 |
| 338,750 | 3/1886 | Johnson | 182/5 |
| 380,173 | 3/1888 | Bovensiep | 182/7 |
| 612,673 | 10/1898 | Reidy et al. | 182/235 |
| 1,241,701 | 10/1917 | Bencur | 182/240 |
| 4,580,658 | 4/1986 | Brda | 182/5 |

*Primary Examiner*—Reinaldo P. Machado

*Attorney, Agent, or Firm*—Cushman, Darby & Cushman

[57] ABSTRACT

A building safety survival rescue cable device includes a large pulley having two pulley halves which are biased toward each other for guiding the rescue device over a cable that is strung from a building. The inner surface of each pulley half is provided with a rough, file-like texture so as to increase friction between the pulley and the cable.

2 Claims, 5 Drawing Figures

BUILDING SAFETY RESCUE DEVICE

BACKGROUND SUMMARY OF THE INVENTION

1. Field of the Invention

The present invention relates to the field of fire safety escape devices. More particularly, the present invention relates to a type of fire escape device whereby a person may safely reach the ground by sliding down a rope that is suspended from a burning building.

2. Description of the Related Art

The frequent fire incidents occurring recently in this country and elsewhere in the world have claimed appreciable casualties. There were those who died of suffocation, by burning, even as a result of jumping to the ground from where they had been caught by a fire high up in a building. All of these deaths indicate the shortage of firefighting and rescuing facilities that exist in metropolitan areas all over the world. To make the situation worse, in a skyscraper access to and from a floor depends virtually entirely upon the elevators. Since a major fire will usually cut off the electricity to the elevators person on the upper floors will frequently be trapped in the building by the fire, and will have to rely on fire fighters or escape devices to save their lives.

In view of the foregoing problems, a proposal has been made to offer a so-called fire rescue device, which includes a brake mechanism wound by a rope. A subject fleeing the fire site is hooked to one end of the rope for descent in a slow and reasonably sure manner to the ground for survival, down from a particular floor in the building where the fire broke out. Such a fire rescue survival device, theoretically should have been a very ideal, safe and practical survival device, but regrettably this was not the case. A survey of the tenants residing in tall buildings will convince you that very few of them have equipped themselves with such a survival device. Why not? Apart from the price issue, these devices have many potential shortcomings including:

1. The speed reduction gearing in such prior art devices makes them too bulky, thus inhibiting a slow and secure descent. While adults can usually manage to use it all right, children can hardly benefit from such a devices.
2. If fixed type braking elements or hydraulic damping mechanisms are used for the speed stabilization unit, the safety feature is inoperative once the braking elements are worn out. When hydraulic damping mechanisms are used, the descending speed will be out of control if there is a leak in the breaking circuit.
3. The teeth of the pulleys used in such devices frequently slip with respect to the support cable, necessitating a coating of cotton over the cable in order to tighten up the engagement. As a result, the outer diameter of the cable was increased, approx. 8 mm or so, and the cable weight increased proportionately. For a tenant residing in the 20th floor or higher, the weight to be offset by the tensile strength of the rope in its entirety and the space needed to store the survival device as a whole was inordinately cumbersome, precluding its use by many persons. Furthermore, the cotton is flammable and may be worn away by friction.
4. The necessity to hang the survival device straddling over the terrace or the wall on which the outermost window is installed, when it is used for rescue, further restricts and applicability of the device.

SUMMARY OF THE INVENTION

Accordingly, the primary object of the present invention is to provide a building safety survival rescue device, wherein the tension-bound cone surface of the cable drawn pulley is made to have a rough file-like surface so as to eliminate the need for a cotton coating over the cable, thus achieving reduction of volume and consequently of weight altogether.

A further object of the present invention is to provide such a building safety survival rescue device, which is sufficiently simple in structure, compact in size and permits adjustment of the descending speed.

A further object of the present invention is to provide such a building safety survival rescue device, which permits descent together with a subject carried thereon by having the free end of the cable fixed to any suitable fixed point in the floor from which the subject is to flee for survival, such as a bed leg, table leg, pillar base and the like.

A further object of the present invention is to provide a building safety survival rescue device, which is provided with a number of baffle sections at suitable intervals leading to the free end of the cable, to prevent incidents due to stall, which may cause sudden falls, particularly when it is misused.

Other features and advantages of the present invention will emerge from the following descriptions of embodiments given by way of illustration, but not in any way limiting, with reference to the accompanying drawings.

DETAILED DESCRIPTION OF THE PREFERRED EMBODIMENT

Figure 1:
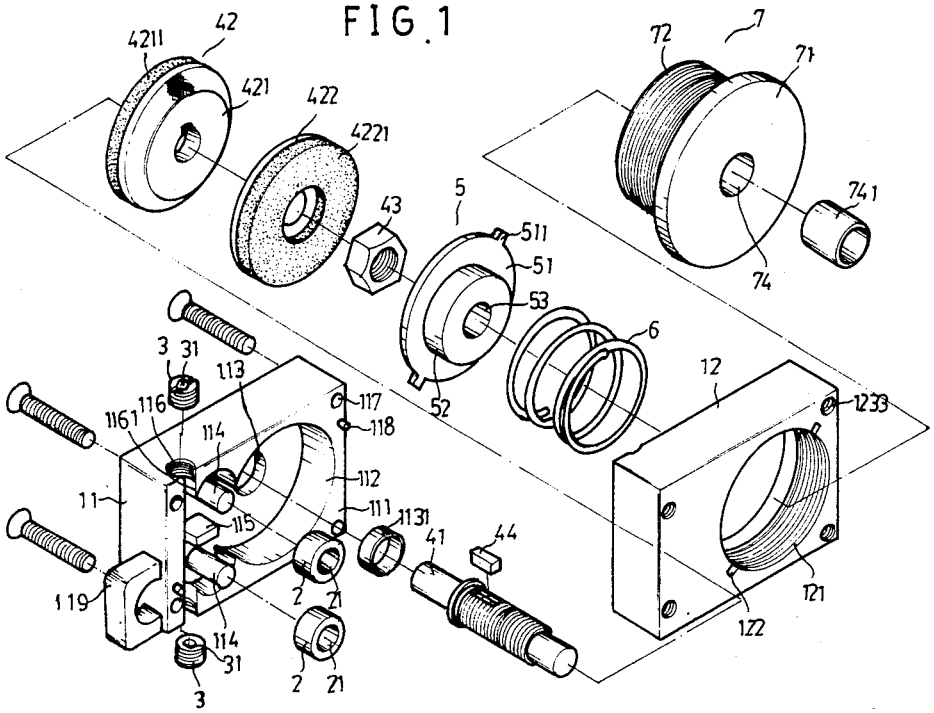
FIG. 1 is an exploded perspective view of all the essential parts comprising the building safety survival rescue device.
Figure 1:
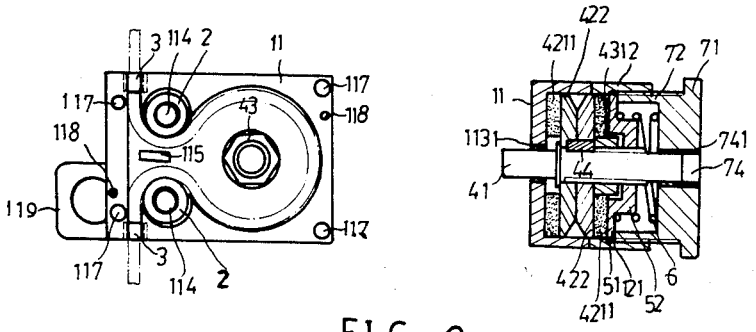

Referring to FIG. 1, it will be seen that the building safety survival rescue device comprises essentially;

a lower shell 11 rectangularly shaped, having a hollow cutout portion 112 provided in the middle of cover-up face 111, a shaft opening 113 amid the bottom of the hollow portion 112, to permit tight engagement of an oiled bearing 1131; two complementary channels on one side of the cover-up face 111, the center of each channel admitting a pulley shaft 114 respectively, both shafts 114 being separated by an outstanding divider 115; a screw hole 116 provided on both sides of the lower shell 11 above and below the divider; a cable groove 1161 vertically oriented to the upper side of the screw hole 116, the width of such a cable groove 1161 being approximately 0.5 mm wider than the outer diameter of the cable; fixing holes 117 on each of the four corners of the upper shell; two fixing stems 118 provided diagonally over the cover-up face 111; and a hook joint 119 provided on one side of the upper shell 11.

A pulley 2 is heat treated over its surface; of which the inner diameter of the shaft hole 21 is 0.1 mm greater than the outer diameter of the pulley shaft 114, and will run about the pulley shaft 114 upon engagement. However, the distance in going from a tangent to the outer diameter of the pulley 2 to the lateral margin of the divider 115 is greater than the outer diameter of the cable.

A cable guide has a guide hole 31 provided in its center and is heat treated. The diameter of the hole 31 is greater than the outer diameter of the cable by approximately 0.1 mm. A screwbolt (not shown) is prepared over the outer diameter to facilitate screwing of the cable guide 3 into screw hole 116.

Figure 2:
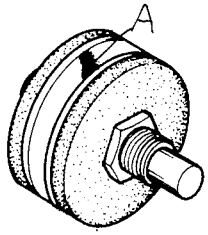
FIG. 2 illustrates a top view and a longitudinal section view of the building safety survival rescue device described hereunder.
Figure 3:
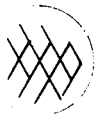
FIG. 3, FIG. 3-A1, and FIG. 3-A2 illustrate the profile of the cable drawn pulley that is used in the present invention.
Figure 3:
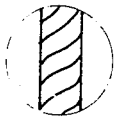

A cable drawn slowgoing pulley is composed of a mandrel 41 and slowgoing pulley 42, said slowgoing pulley 42 incorporating two circular blocks 421, 422 that are cambered over their perimeters and have a rough, file-like surface, as shown in FIGS. 3A-1 and 3A-2. The pulley blocks are coupled to the two solenoids 421 and 422, so that the spacing therebetween may be adjusted over the mandrel 41, so as to produce a tensioned front, in the form of an inverted cone, acting upon the cable. By bolting pulley 42 with a screw nut 43, pulley 42 is held in position by a key 44. A plurality of braking elements 4211, 4221 are fitted directly to the outer rim of both solenoids 421 and 422, such that the outer diameter of the pulley 42 is smaller thn that of the hollow cutout portion 112 provided in the center of the lower shell 11 by 0.2 mm.

It is permissible to form the cable drawn slowgoing pulley 42 in a one-piece structure, but the pulley is preferably formed as an inverted cone that is provided over the perimeter of the outer rim of one of the solenoids 421 or 422, the opposing slopes of the cones being die-cast to yield a clearance and threads having a shape identical to those threads binding the cable coil, to provide a tensioned front acting upon the cable, as would be better understood by referring to FIG. 1.

A compression member 5 is made in the form of two concentric annular formations, one of the formations comprising a stay ring 51 which has the larger outer diameter and has two stay bolts 511 provided diagonally over the perimeter, the other formation being a resilient stay belly 52 of a smaller outer diameter. A passage hole 53 is provided through the concentric center of the compression member 5.

An upper shell 12, rectangular in shape, of which the length and the width are identical to those of the lower shell 11, has a threaded hollow cutout portion 121 provided therethrough. The outer diameter is identical to that of the hollow cutout portion 112 provided in the centre of the lower shell 11. There are two recessed stays 122 provided diagonally at the side edge of the threaded hollow cutout portion 121. Two fixing holes and two pulley shaft pin holes are provided over the cover-up face. Each of the four corners of the upper shell 12 are complete with a plurality of fixing screw holes 1233 facilitate integration with the lower shell 11.

A compression spring 6, one end thereof being attached to resilient stay belly 52 relative to the compression member 5, the other end being engaged in a descent speed adjustment button 7, is further described in the text to follow.

The descent speed adjustment button 7 includes a knob handle 71 on one end and has a greater outer diameter than a screwbolt 72 on the other end. Screw bolt 72 is meant for rotative engagement into the threaded hollow cutout portion 121 in the center of upper shell 12. A spring stay hole is provided centrally on the edge of screwbolt 72, to accommodate compression spring 6. A shaft hole 74 for penetration across the terminal end of knob handle 71 is provided centrally in the knob handle 71 and the screw bolt 72, the shaft hole 74 being accessed by an oiled bearing 741 in a tight-bound condition.

A cable shown in FIG. 2 has, for example, a diameter of 30 mm for application in the preferred embodiment and is capable of withstanding a load of up to 400 kgs, for instance. The free end of the cable is to be fixed to a suitable stronghold in the floor in which the user resides, to permit safe release of the cable to an elevation approximately 15 meters above the ground level, or other appropriate height, which is variable from case to case. The cable should be applied with a layer of a thin film bonding agent in several sections over the surface, as a coating which provides an addition of 0.15 to 0.2 mm to the outer diameter of the cable as seen in cross-section to serve as a safe buffer. The front end of the cable bears against a spring hook (not shown).

For a description of the assemblage of the invention reference is made to FIG. 2 in which it is seen that once the cable drawn pulley 42 has been secured to the mandrel 41, the cable is to be wound around the tensioned front in order to bear upon the cable in the form of an inverted cone over the perimeter of the slowgoing pulley 42. After the front end of mandrel 41 is engaged into oiled bearing 741, the cable drawn slowgoing pulley 42 is secured into the hollow cutout portion 112 and is run through the path between pulley 2 and divider 115, for passage via guide hole 31 for the cable guide 3, in a manner whereby the guide 3 is passed into cable guide to facilitate sealing of slowgoing pulley 42 together with the cable into hollow cutout portion 112. The outgoing cable then is put into screwhole 116 via cable groove 1161, for subsequent screwing of the cable guide 3 into screwhole 113. As a final step, the upper shell 12 is integrated together with the lower shell 11 by fixing of the fixing stems 118. Thereupon, the front end of the pulley shaft 114 relative to the lower shell 11 will be secured in the pulley shaft pin hole to reinforce the strength of the pulley shaft 114 in bearing against the load weights.

Once both the upper shell 12 and the lower shell 11 are locked together, two stay bolts 511 outstanding on the compression member 5 will be inserted into recesses 122 relative to the threaded hollow cutout portion 121 alongside the upper shell 12, thereby bringing the stay ring 51 integral with the compression member 5 adhered levelwise to the braking elements 4211 and 4221 in the cable drawn slowgoing pulley 42. Next, the compression spring 6 is to be fitted into the resilient stay belly 52 on top of the compression member 5, and the screwbolt 72 of the descent speed adjustment button 7 is rotatively screwed into the threaded hollow cutout portion 121 for tensile bearing against the compression spring 6. In the meantime, the rear part of the mandrel 41 has been inserted into a bearing in the center of the adjustment button 7, whereupon assemblage of the building safety survival rescue device is accomplished and is ready for service.

In operation, the frontal end of the cable bound by the presence of a spring hook ahead should be wound in a secured position over an immovable stronghold which can be a pillar, a bed leg, a table leg, or the like. The individual fleeing the fire site sits himself in a hooked seat relative to the lower shell, to which a harness, that is, a rescue garment, is attached by snap-on hooks. The rescue device will descend, carrying the subject in a slow but sure manner to the ground. The descending speed may be changed by the subject manually adjusting the descent speed adjustment button 7. This adjusts the friction between the compression member 5 and the braking elements 4211 and 4221.

An additional worthwhile feature of the cable guide hole 3 lies in the safe buffering performance as the descent is in progress in a joint effort with the baffle. These effects are realized by the application of a thin film over the cable as disclosed hereinbefore, because such a film application provides for an outer diameter of the baffle section of the cable that is 0.15 to 0.2 mm greater than the diameter of the cable guide hole which is merely 0.1 mm greater than the cable, so that should the rescue device stall and be about to fall headlong due to improper operation, say, by a child, the buffered section of the cable having been applied with a film coating will pass the cable drawn guide hole when the rescue device comes down to a critical point approximately 15 M from the ground, whereupon the slowgoing buffered descent is realized by virtue of such a differential in the outer diameter by 0.04 to 0.01 mm and the mollifying nature of the tin film.

What the claim is:

1. A building safety survival rescue cable device, comprising:

a lower shell casing having a cutout portion therein with an opening therethrough and also having side walls with a pair of cable guide holes passing therethrough;

a pair of pulley shafts secured in the cutout portion of the lower shell casing;

a pair of relatively small pulleys engaged with the pair of pulley shafts;

a mandrel being arranged in the lower shell casing and having one end passing through the opening in the cutout portion of the lower shell casing;

a pair of braking elements mounted on the mandrel in the cutout portion of the lower shell casing;

a large pulley engaged between the pair of braking elements;

an upper shell casing secured over the lower shell casing and having a cutout portion aligned with the cutout portion of the lower shell casing;

a compression means, mounted on the mandrel, for acting upon the pair of braking elements;

a compression spring means, arranged around the mandrel, for forcing the compression means into engagement with the pair of compression means; and a descent speed adjustment button secured in the cutout portion of the upper shell casing, said button having an opening for engaging an opposite end of the mandrel, said button also having a bolt portion for exerting force upon the compression spring means, and said button further having a knob handle means for changing the amount of force exerted by the bolt portion upon the compression spring means.

2. The building safety survival rescue cable device according to claim 1, wherein said large pulley comprises a pair of circular blocks, each of said blocks having a peripherally tapered surface on one side thereof, so as to form a V-shaped notch between said blocks for said cable, each of said tapered surfaces being provided with a rough file-like texture, so as to increase friction between said surfaces and said cable.

* * * * *